US009004949B2

(12) United States Patent
Chang

(10) Patent No.: US 9,004,949 B2
(45) Date of Patent: Apr. 14, 2015

(54) STACKED ELECTRIC CONNECTOR HAVING BUILT-IN HUB INTEGRATED CIRCUIT

(71) Applicant: Nai-Chien Chang, New Taipei (TW)

(72) Inventor: Nai-Chien Chang, New Taipei (TW)

( * ) Notice: Subject to any disclaimer, the term of this patent is extended or adjusted under 35 U.S.C. 154(b) by 84 days.

(21) Appl. No.: 13/838,085

(22) Filed: Mar. 15, 2013

(65) Prior Publication Data

US 2013/0309909 A1 Nov. 21, 2013

(30) Foreign Application Priority Data

May 16, 2012 (TW) ..... 101209228 U

(51) Int. Cl.

| | |
|---|---|
| ***H01R 13/60*** | (2006.01) |
| ***H01R 13/66*** | (2006.01) |
| ***H01R 24/62*** | (2011.01) |
| ***H01R 31/00*** | (2006.01) |
| *H01R 12/72* | (2011.01) |

(52) U.S. Cl.

CPC ..... *H01R 13/6658* (2013.01); *H01R 12/724* (2013.01); *H01R 24/62* (2013.01); *H01R 31/005* (2013.01)

(58) Field of Classification Search

CPC . H01R 13/6658; H01R 13/6683; H01R 13/66
USPC ..... 439/620.21–620.23, 541.5, 76.1
See application file for complete search history.

(56) References Cited

U.S. PATENT DOCUMENTS

| | | | | |
|---|---|---|---|---|
| 6,062,904 | A * | 5/2000 | Oguchi et al. | 439/541.5 |
| 6,129,564 | A * | 10/2000 | Kawamae et al. | 439/541.5 |
| 6,287,129 | B1 * | 9/2001 | Kuo | 439/541.5 |
| 7,008,762 | B2 * | 3/2006 | Zhang et al. | 439/541.5 |
| 7,261,592 | B2 * | 8/2007 | Korsunsky et al. | 439/541.5 |
| 7,922,538 | B2 * | 4/2011 | Chang | 439/620.16 |

* cited by examiner

*Primary Examiner* — Felix O Figueroa
(74) *Attorney, Agent, or Firm* — Muncy, Geissler, Olds & Lowe, P.C.

(57) ABSTRACT

A stacked electric connector includes an insulating body, multiple electrically conductive terminals, a circuit board, a hub integrated circuit, and multiple outputting terminals. Multiple tongues portions extend forwards from the insulating body. Multiple terminal slots are disposed within the tongue portions. The electrically conductive terminals are disposed within the terminal slots. One end of each electrically conductive terminal extends out of the insulating body and is electrically connected to the circuit board. The electrically conductive terminals and the tongue portions together construct multiple connecting ports having the same interface. The hub IC is disposed on the circuit board and electrically connected to the electrically conductive terminals. The outputting terminals are disposed on the circuit board and electrically connected to the hub IC. An amount of the outputting terminals is equal to an amount of the electrically conductive terminals of each connecting port.

9 Claims, 7 Drawing Sheets

STACKED ELECTRIC CONNECTOR HAVING BUILT-IN HUB INTEGRATED CIRCUIT

BACKGROUND OF THE INVENTION

1. Field of the Invention

The present invention relates to an electric connector, and in particular to a stacked electric connector.

2. Description of Related Art

In the developed electronic industry, a wide variety of electronic apparatus are ubiquitous in life. In order to operate the electronic apparatus by inputting commands, or transmit data between the electronic apparatus, a plurality of connectors are disposed on main board of most electronic apparatus.

As the periphery products of the electronic apparatus become diverse, the demand of the electric connector grows. Therefore, the electric connectors applied, in a single electronic apparatus are demanded with increased number. However, too many electric connectors will occupy disposing space of the main board of the electronic apparatus, and thus the volume of the electronic apparatus is difficult to reduce.

In order to solve the problem mentioned above, a stacked electric connector is invented. The staked electric connector includes a plurality of connecting ports staked in a vertical direction and has area of only one connector. This is, the staked electric connector provides the space of vertical direction at the expense of the space of the horizontal direction. For the main board of the electronic apparatus, the stacked electric connector includes multiple connectors and only occupies the area of one connector, therefore, considerable disposing space can be saved to dispose other component or the area of the main board can be reduced.

However, when the amount of the connector of the stacked electric connected is increased, or the amount of the terminals included by the connecting ports is increased, the excessive outputting terminals are includes by the stacked electric connector. The stacked electric connector is disposed on the main board by the area of only one electric connector with limited space, therefore when excessive outputting terminals are arranged in the stacked electric connector, soldering holes disposed on the main board will become close, and this causes difficulty in manufacture and slows the speed of manufacture. Moreover, the amount of the soldering holes disposed on the area of only one electric connector increases the complexity of the circuit patterns.

SUMMARY OF THE INVENTION

It is an object to provide a stacked electric connector having built-in hub integrated circuit (IC), the stacked electric connector has multiple connecting ports stacked in a housing and controlled by the hub IC, and the amount of the pins of stacked electric connector connected to external is equal to the pins of only one connecting port.

Accordingly, the stacked electric connector having built-in hub IC according to the present invention is connected to a main board of an external electronic device and includes an insulating body, a plurality of electrically conductive terminals, a circuit board, a hub integrated circuit (IC), and a plurality of outputting terminals. A plurality of tongues portions extend forwards from a front-end surface of the insulating body, and a plurality of terminal slots are disposed within the tongue portions. The electrically conductive terminals are respectively disposed within the terminal slots of the tongue portions. One end of each electrically conductive terminal extends out of the insulating body and electrically connected to the circuit board. The electrically conductive terminals and the tongue portions together construct a plurality of connecting ports having the same interface. The hub IC is disposed on the circuit board and electrically connected to the electrically conductive terminals via the circuit board. The outputting terminals are disposed on the circuit board and electrically connected to the hub IC via the circuit board. An amount of the outputting terminals is equal to an amount of the electrically conductive terminals of each connecting port.

In generally, the stacked electric connector includes a plurality of connecting ports stacked thereon, and the amount of the outputting terminals is equal to the amount of the electrically conductive terminals of the connecting ports. Such that, the more the connecting ports are stacked, the more the outputting terminals are included. The effect of the stacked electric connector having built-in hub IC according to the present invention is that the amount of the outputting terminals is equal to the amount of the electrically conductive terminals of each connecting port, and no matter the stacked electric connector having bub IC includes how many stacked electric connecting ports. Therefore, the circuit patterns of the main board using the stacked electric connector having built-in hub IC according to the present invention can be effectively simplified.

BRIEF DESCRIPTION OF DRAWING

The features of the invention believed to be novel are set forth with particularity in the appended claims. The invention itself, however, may be best understood by reference to the following detailed description of the invention, which describes an exemplary embodiment of the invention, taken in conjunction with the accompanying drawings, in which:

DETAILED DESCRIPTION OF THE INVENTION

A preferred embodiment of the present invention will be described with reference to the drawings.

Figure 1:
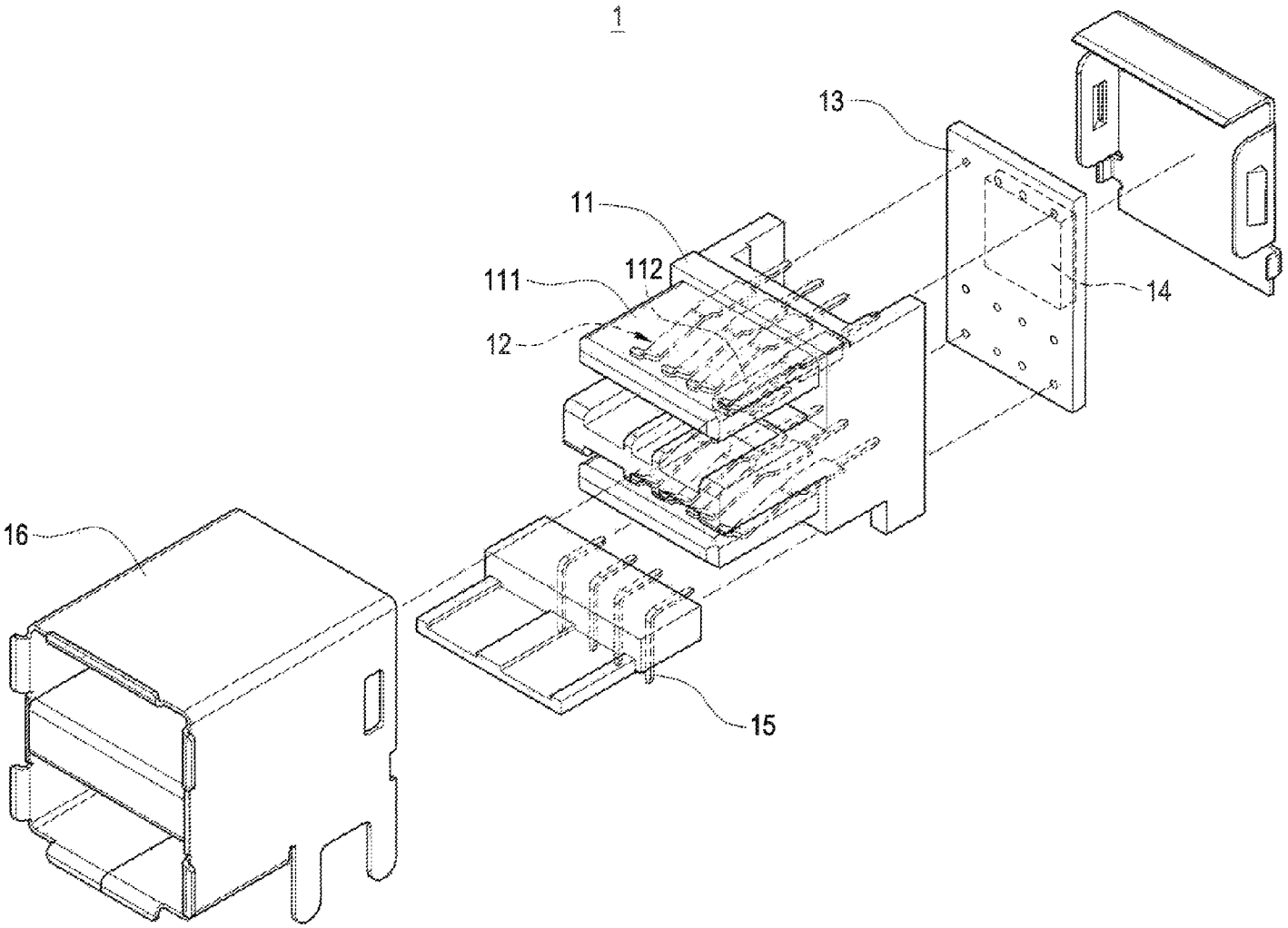
FIG. 1 is an exploded view of a stacked electric connector having built-in hub integrated circuit (IC) according to a first embodiment of the present invention.
Figure 2:
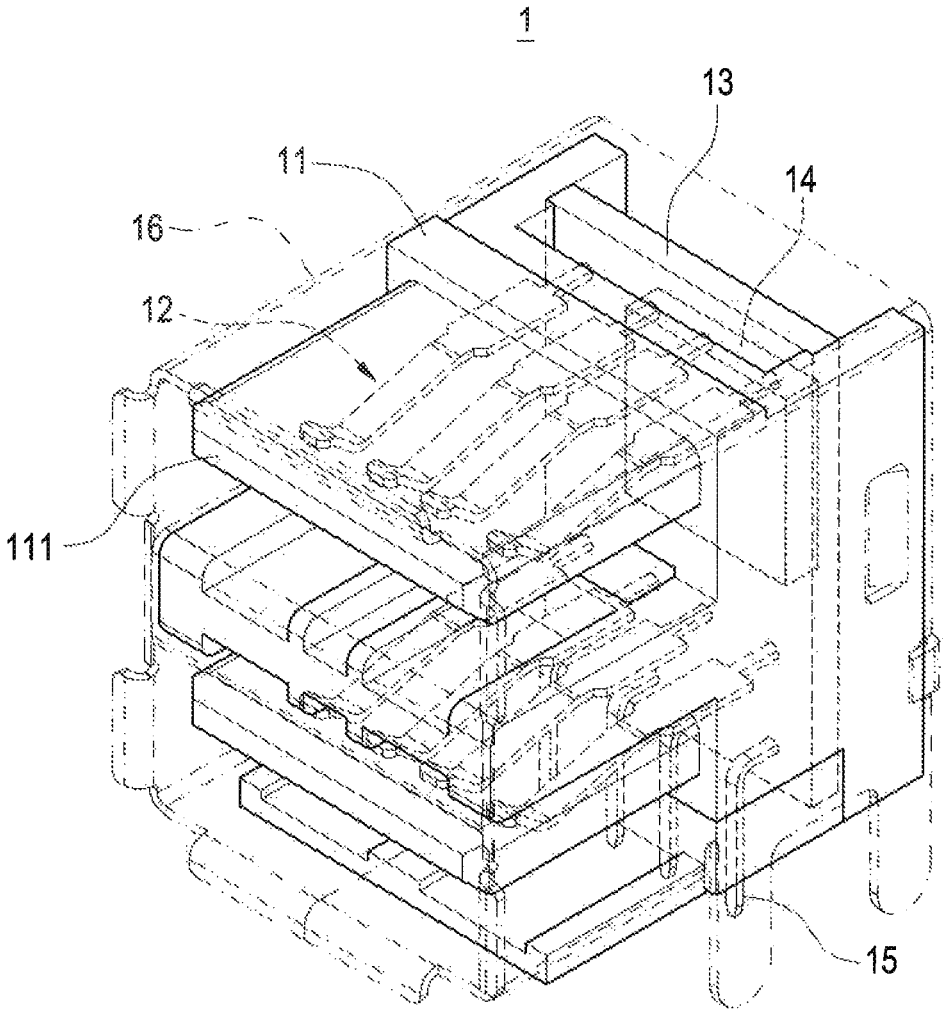
FIG. 2 is an assembly view of the stacked electric connector having built-in hub IC according to the first embodiment of the present invention.
Figure 3:
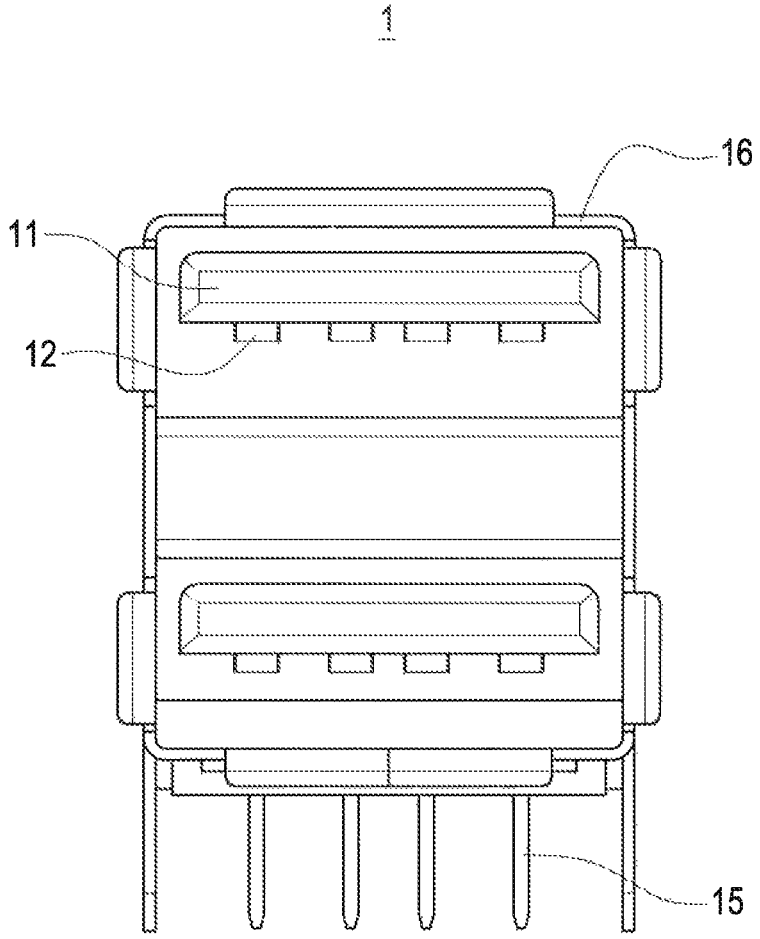
FIG. 3 is a front view of the stacked electric connector having built-in hub IC according to the first embodiment of the present invention.

Reference is made to FIG. 1, FIG. 2, and FIG. 3, FIG. 1 is an exploded view of a stacked electric connector having built-in hub integrated circuit (IC) according to a first embodiment of the present invention, FIG. 2 is an assembly view of the stacked electric connector having built-in hub IC according to the first embodiment of the present invention, and FIG. 3 is a front view of the stacked electric connector having built-in hub IC according to the first embodiment of the present invention. The stacked electric connector having built-in hub IC 1 includes an insulating body 11, a plurality of electrically conductive terminals 12, a circuit board 13, a hub IC 14, and a plurality of outputting terminals 15.

A plurality of tongue portions 111 extend forwards from a front-end surface of the insulating body 11. The tongue portions 111 are perpendicular to the insulating body 11. A plurality of terminal slots 112 are respectively disposed within the tongue portions 111 for accommodating the electrically conductive terminals 12 therein. The electrically conductive terminals 12 are respectively disposed within the terminal slots 112, thereby a plurality of connecting ports are constructed by the electrically conductive terminals 12 and the tongue portions 111. In particularly, the connecting ports have (but are not limited to have) the same interface. As shown in FIG. 1, the amount of the tongue portions 111 is two, and the amount of the terminal slots 112 disposed within each tongue portions 111 is four. The amount of the electrically conductive terminals 12 is eight, and the electrically conductive terminals 12 are respectively disposed within the terminal slots 112, such that connecting ports of universal series bus (USB) 2.0 are constructed by the eight electrically conductive terminals 12 and the two tongue portions. In particularly, each connecting port includes four electrically conductive terminals 12.

In this embodiment, the circuit board 13 is disposed on another end surface of the insulating body 11, the end surface is far away from the tongue portions 111. The electrically conductive terminals 12 are respectively extending out of the insulating body 11 and electrically connected to the circuit board 13 disposed on another end surface of the insulating body 11. The hub IC 14 is disposed on the circuit board 13 and electrically connected to the electrically conductive terminals 12 via the circuit board 13. The outputting terminals 15 are disposed on the circuit board 13 and electrically connected to the hub IC 14 via the circuit board 13.

In generally, the amount of terminals disposed on an inputting end of a stacked electric connector must be equal to the amount of terminals disposed on an outputting end. For example, the amount of outputting terminals of a stacked electric connector having two USB 2.0 connecting ports is eight, and another amount of outputting terminals of a stacked electric connector having two external serial advanced technology attachment (e-SATA) connecting ports is fourteen. However, the stacked electric connector having built-in hub IC 1 according to the present invention can reduce the amount of the outputting terminals 15 via the hub IC 14, as describe below.

The hub IC 14 is simultaneously and electrically connected to the connecting ports for controlling and integrating signals and electronic power of the connecting ports, and then transmitting the controlled and integrated signals outsides via a single passageway. Therefore, in a supported amount of the hub IC 14, no matter the amount of the connecting ports is connected to the inputting end, the amount of the outputting terminals is only equal to the electrically conductive terminals of each connecting port for outputting. As shown in FIG. 1, the amount of the connecting ports is two, and the amount of the electrically conductive terminals 12 is eight. However, the amount of the outputting terminals 15 integrated and controlled by the hub IC 14 is equal to the amount of each connecting port, and in this embodiment, the amount of the outputting terminals 15 is four. In FIG. 1, the connecting ports are, for example, USB 2.0 connecting ports, and each USB 2.0 connecting port includes four electrically conductive terminals 12. That is, if the stacked electric connector having built-in hub IC 1 includes one or more USB 2.0 connecting ports, the amount of the outputting terminals 15 is only four.

The stacked electric connector having built-in hub IC 1 further includes a metallic shell 16 for covering the insulating body 11, the electrically conductive terminals 12, the circuit board 13, the hub IC 14, and the outputting terminals 15. Therefore, the stacked electric connector having built-in hub IC 1 has metal-shielding effect to prevent signal interference when transmitting signals.

Figure 4:
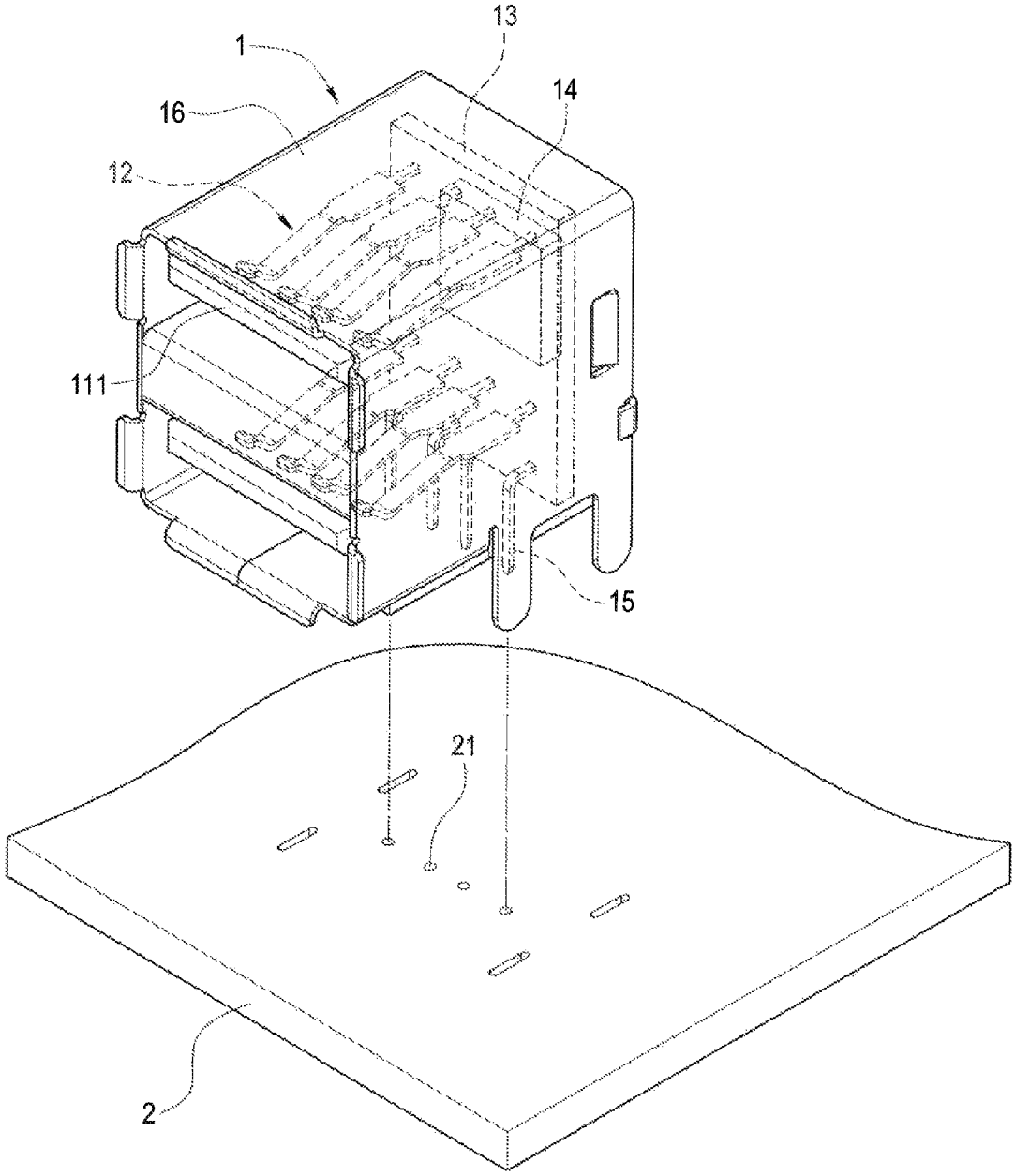
FIG. 4 is a schematic view of usage state of the stacked electric connector having built-in hub IC according to the first embodiment of the present invention.

Reference is made to FIG. 4, which is a schematic view of usage state of the stacked electric connector having built-in hub IC according to the first embodiment of the present invention. The stacked electric connector having built-in hub IC 1 is electrically connected to a main board 2 of an external electronic device. In particularly, the outputting terminals 15 are soldered on a plurality of soldering holes 21 disposed on the main board 2 in advance. As shown in FIG. 4, the stacked electric connector having built-in hub IC 1 has two USB 2.0 connecting ports, and the amount of the electrically conductive terminals 12 is eight. However, since the integrating of the hub IC 14, the stacked electric connector having built-in hub IC 1 is electrically connected to the main board 2 only by four outputting terminals 15. Therefore, if manufacturers for making the main board 2 use the stacked electric connector having built-in hub IC according to the present invention, the amount of the soldering holes 21 disposed on the main board 2 and corresponding to the outputting terminals 15 is four, and less than the amount of eight in normal, thus the manufacturing cost is effectively reduced, and the circuit pattern of the main board 2 is effectively simplified.

Figure 5:
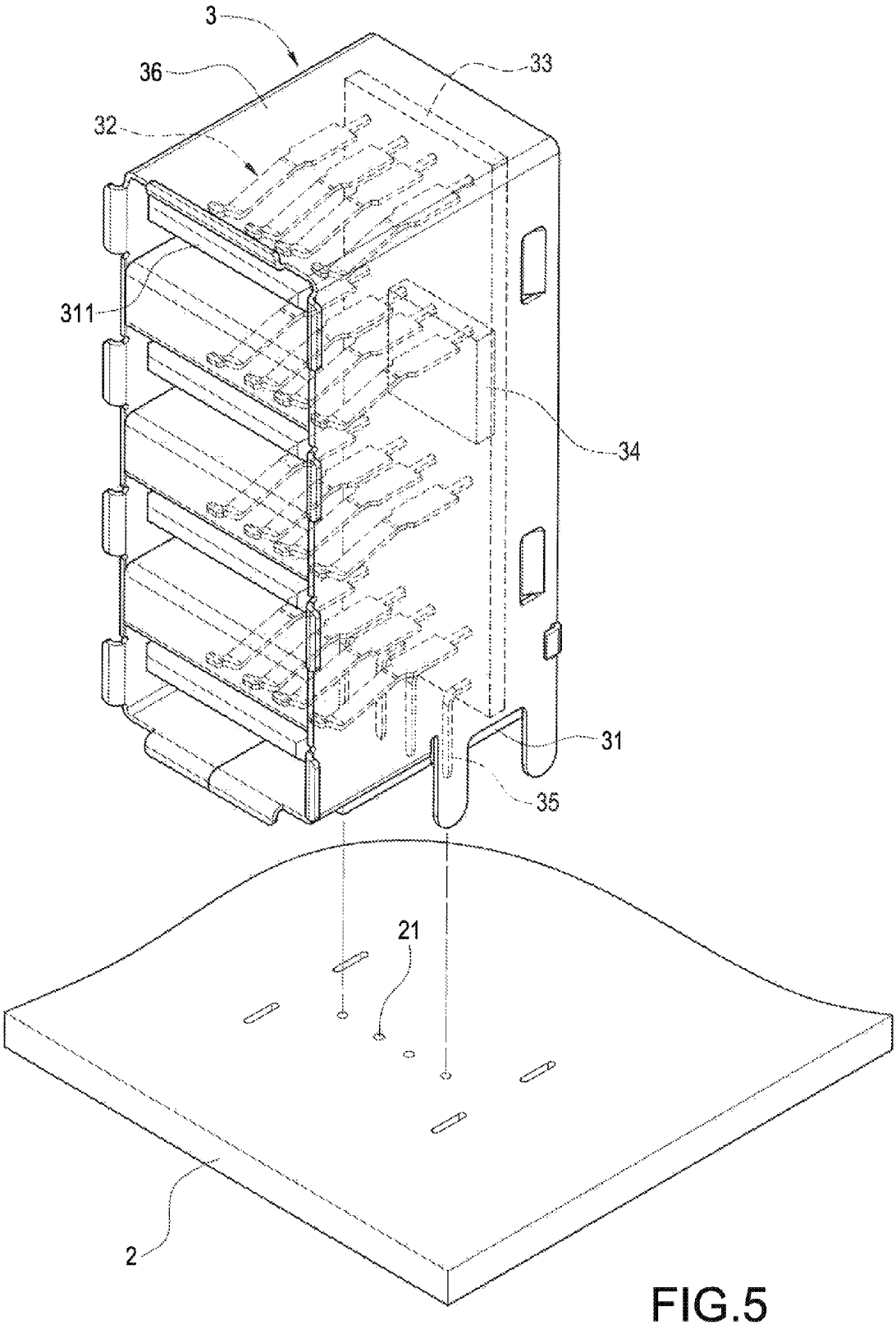
FIG. 5 is a schematic view of usage state of a stacked electric connector having built-in hub IC according to a second embodiment of the present invention.

Reference is made to FIG. 5, which is a schematic view of usage state of a stacked electric connector having built-in hub IC according to a second embodiment of the present invention. The stacked electric connector having built-in hub IC includes an insulating body 31, a plurality of electrically conductive terminals 32, a circuit board 33, a hub IC 34, a plurality of outputting terminals 35, and a metallic shell 36. Four tongue portions 311 extend forwards from a front-end surface of the insulating body 31. The amount of the electrically conductive terminals is sixteen, and respectively disposed within the tongue portions 311, such that four USB 2.0 connecting ports are constructed. The sixteen electrically conductive terminals 32 are respectively extending out of the insulating body 31 and electrically connected to the circuit board 33, and then electrically connected to the hub IC 34 via the circuit board 33.

The stacked electric connector having built-in hub IC 3 integrates and controls the electrically conductive terminals 32 via the hub IC 34, thus the manufacturing cost can be reduced and the circuit patterns of the main board 2 can be simplified because the stacked electric connector having built-in hub IC 3 only uses four outputting terminals 35 to electrically connect the soldering holes 21 of the main board 2.

As shown in the FIG. 1, the amount of the connecting ports is, for example, two, and as shown in FIG. 5, the amount of the connecting ports is, for example, four. However, the amount of the connecting ports may be any number, such as three, five, six or seven as long as the amount is supported by the huh IC 14, 34.

Figure 6:
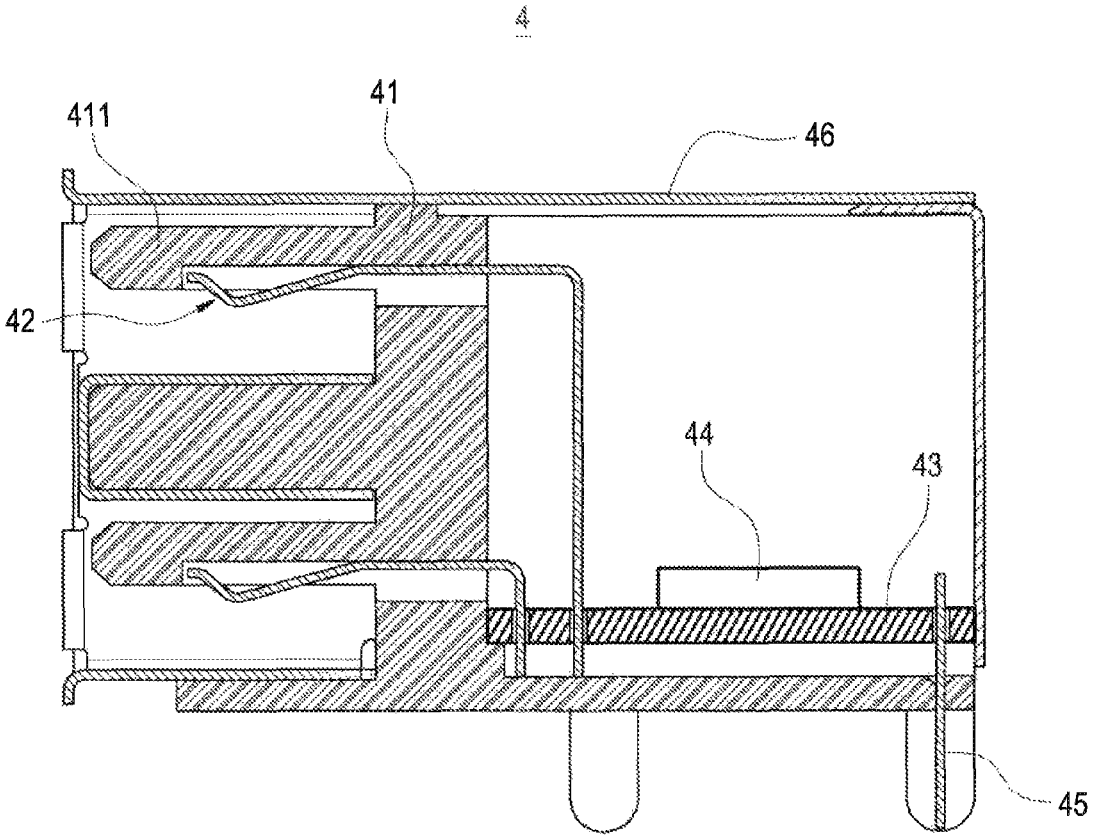
FIG. 6 is a sectional view of a stacked electric connector having built-in hub IC according to a third embodiment of the present invention.

Reference is made to FIG. 6, which is a sectional view of a stacked electric connector having built-in hub IC according to a third embodiment of the present invention. The stacked electric connector having built-in hub IC 4 includes an insulating body 41, a plurality of electrically conductive terminals 42, a circuit board 43, a hub IC 44, a plurality of outputting terminals 45, and a metallic shell 16. A plurality of tongue portions 411 extend forwards from a front-end surface of the insulating body 41. The electrically conductive terminals are respectively disposed within the tongue portions 411, and a plurality of connecting ports having the same interface are then constructed.

The circuit board 42 is horizontally disposed within the stacked electric connector having built-in hub IC 4, and is perpendicular to the insulating body 41. In particularly, the insulating body 41 is perpendicular to an end surface of the circuit board 43, the end surface is far away from the tongue portions 411. One end of each electrically conductive terminal 42 extends out of the insulating body 41 and is bent downwards for electrically connected to the circuit board 43. The electrically conductive terminals 42 are also electrically connected to the hub IC 44 via the circuit board 43. The advantage of the stacked electric connector having built-in hub IC 4 according to the third embodiment of the present invention is that the contacts of the electrically conductive terminal 42 and the circuit board 43 are concentrated on the front end of the circuit board 43, such that the rear end of the circuit board 43 has large space for facilitating the designing of circuit patterns.

Figure 7:
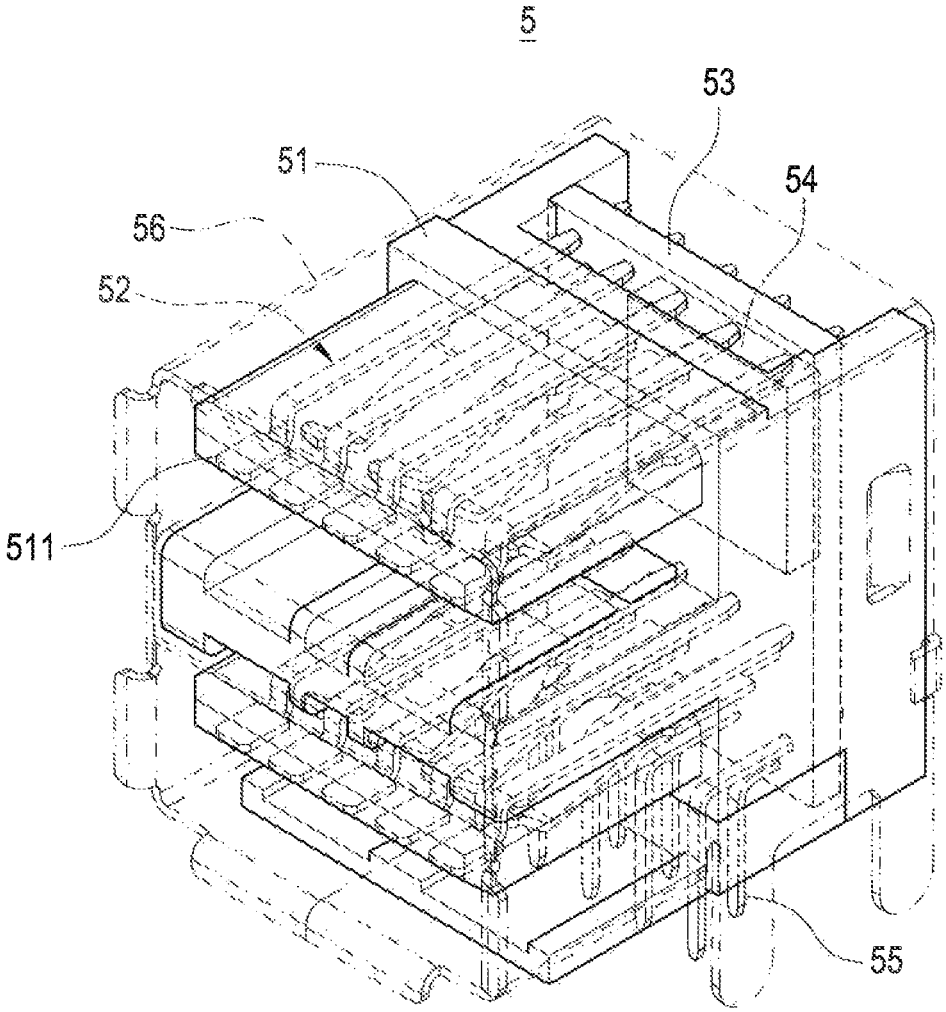
FIG. 7 is an assembly view of a stacked electric connector having built-in hub IC according to a forth embodiment of the present invention.

Reference is made to FIG. 7, which is an assembly view of a stacked electric connector having built-in hub IC according to a forth embodiment of the present invention. The stacked electric connector having built-in hub IC 5 includes insulating body 51, a plurality of electrically conductive terminals 52, a circuit board 53, a hub IC 54, a plurality of outputting terminals 55, and a metallic shell 56 as the embodiment mentioned above. A plurality of tongue portions 511 extend forwards from a front-end surface of the insulating body 51. The electrically conductive terminals 52 are respectively disposed within the tongue portions 511, and then a plurality of connecting ports having the same interface are constructed.

The connecting ports of the stacked electric connector having built-in hub IC 5 are USB 3.0 connecting pots, and each connecting port includes nine electrically conductive terminals 52. In the FIG. 7, the amount of the tongue portions 511 is two, and the amount of the electrically conductive terminals 52 is eighteen. The amount of the outputting terminals 33 is corresponding to the amount of the electrically conductive terminals 52 of each connecting portion, and in this embodiment, the amount of the outputting terminals is nine. In another embodiment, the amount of the tongue portions 511 is four, the amount of the electrically conductive terminals 52 is thirty-six. However, the outputting terminals 55 integrated and controlled by the hub IC 54 is nine.

To sum up, the stacked electric connector having built-in hub IC of the present invention effectively reduces the amount of outputting terminals, such that the amount of the soldering holes 21 disposed on the main board 2 can be reduced and the circuit patterns placed on the main board 2 can be simplified. The manufacturing speed of the main board 2 is effectively improved and the manufacturing cost is effectively reduced.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A stacked electric connector having a built-in hub integrated circuit (IC) connected to a main board of an external electronic device, the stacked electric connector comprising:

an insulating body, a plurality of tongues portions extending forwards from a front-end surface of the insulating body, and a plurality of terminal slots disposed within the tongue portions;

a circuit board;

a plurality of electrically conductive terminals respectively disposed within the terminal slots of the tongue portions, one end of each electrically conductive terminal extending out of the insulating body and electrically connected to the circuit board, wherein the electrically conductive terminals and the tongue portions together construct a plurality of connecting ports having a same type of interface;

a hub IC disposed on the circuit board and simultaneously and electrically connected to the electrically conductive terminals of the plurality of connecting ports via the circuit board; and a plurality of outputting terminals disposed on the circuit board and electrically connected to the hub IC via the circuit board, wherein the plurality of outputting terminals constructs a single passageway of the stacked electric connector, wherein an amount of the outputting terminals is equal to an amount of the electrically conductive terminals of one of the plurality of connecting ports, and the hub IC controls and integrates signals and electronic power of the connecting ports, and transmitting the controlled and integrated signals outsides via the single passageway.

2. The stacked electric connector as claimed in claim 1, wherein the circuit board is disposed on another end surface of the insulating body, the end surface is far away from the tongue portions.

3. The stacked electric connector as claimed in claim 2, wherein the circuit board is horizontally disposed within the staked electric connector having built-in hub IC, and is perpendicular to the insulating body, the electrically conductive terminals extend out of the insulating body and are bent downwards for electrically connecting to the circuit board.

4. The stacked electric connector as claimed in claim 1, further comprising a metallic shell covering the insulating body, the electrically conductive terminals, the circuit board, the hub IC, and the outputting terminals.

5. The stacked electric connector as claimed in claim 1, wherein the connecting ports are connecting ports having universal serial bus (USB) 2.0 interface, and the amount of the electrically conductive terminals of each connecting port is four.

6. The stacked electric connector as claimed in claim 5, wherein an amount of the tongue portions is two, the amount of the electrically conductive terminals is eight, and the amount of the outputting terminals is four.

7. The stacked electric connector as claimed in claim 5, wherein an amount of the tongue portions is four, the amount of the electrically conductive terminals is sixteen, and the amount of the outputting terminals is four.

8. The stacked electric connector as claimed in claim 1, wherein the connecting ports are a connecting ports having universal serial bus (USB) 3.0 interface, and the amount of the electrically conductive terminals of each connecting port is nine.

9. The stacked electric connector as claimed in claim 8, wherein an amount of the tongue portions is two, the amount of the electrically conductive terminals is eighteen, and the amount of the outputting terminals is nine.

* * * * *